US008157338B2

(12) United States Patent
Seo et al.

(10) Patent No.: US 8,157,338 B2
(45) Date of Patent: Apr. 17, 2012

(54) REFRIGERATOR

(75) Inventors: Woon Kyu Seo, Gyeongsangnam-do (KR); Jung Yeon Hwang, Gyeongsangnam-do (KR); Han Jin Jung, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 55 days.

(21) Appl. No.: 12/725,485

(22) Filed: Mar. 17, 2010

(65) Prior Publication Data

US 2011/0006655 A1 Jan. 13, 2011

(30) Foreign Application Priority Data

Jul. 7, 2009 (KR) ..... 10-2009-0061420

(51) Int. Cl.
*A47B 96/04* (2006.01)

(52) U.S. Cl. ..... 312/402; 312/404; 312/308; 312/301

(58) Field of Classification Search ..... 312/401, 312/298, 308, 405, 402, 404, 330.1, 301, 312/334.1, 334.8; 62/382
See application file for complete search history.

(56) References Cited

U.S. PATENT DOCUMENTS

| | | | | |
|---|---|---|---|---|
| 2,711,944 | A * | 6/1955 | Meek et al. | 312/333 |
| 4,087,140 | A * | 5/1978 | Linstromberg | 312/292 |
| 5,152,231 | A * | 10/1992 | Preston et al. | 109/65 |
| 5,157,940 | A * | 10/1992 | Bertu et al. | 62/382 |
| 6,641,239 | B2 * | 11/2003 | Kaiser | 312/404 |
| 6,724,303 | B2 * | 4/2004 | McGunn et al. | 340/521 |
| 7,063,252 | B2 * | 6/2006 | Smith et al. | 235/379 |
| 7,082,783 | B2 * | 8/2006 | Uihlein et al. | 62/441 |
| 7,104,621 | B2 * | 9/2006 | Choi | 312/296 |
| 7,108,338 | B2 * | 9/2006 | Katsuyama et al. | 312/301 |
| 7,261,385 | B2 * | 8/2007 | Weinberger | 312/330.1 |
| 7,380,410 | B2 * | 6/2008 | Rand et al. | 62/302 |
| 7,744,173 | B2 * | 6/2010 | Maglinger et al. | 312/333 |
| 8,002,369 | B2 * | 8/2011 | Bello | 312/410 |
| 8,061,790 | B2 * | 11/2011 | Anikhindi et al. | 312/402 |
| 8,067,915 | B2 * | 11/2011 | Hooker et al. | 318/466 |
| 2004/0164654 | A1 * | 8/2004 | Laible | 312/122 |
| 2005/0017607 | A1 * | 1/2005 | Weinberger | 312/215 |
| 2006/0049731 | A1 * | 3/2006 | Choi et al. | 312/330.1 |

(Continued)

FOREIGN PATENT DOCUMENTS

| | | | |
|---|---|---|---|
| JP | 04-045382 | A | 2/1992 |
| JP | 2006-141797 | A | 6/2006 |
| WO | WO 2009/081249 | A1 | 7/2009 |

OTHER PUBLICATIONS

European Search Report dated Apr. 1, 2011 for Application No. EP 10160310, 6 pages.

*Primary Examiner* — Darnell Jayne
*Assistant Examiner* — Kimberley S Wright
(74) *Attorney, Agent, or Firm* — Fish & Richardson P.C.

(57) ABSTRACT

A refrigerator is provided. The refrigerator includes a cabinet defining a storage space, a drawer type door withdrawably disposed on the cabinet, the drawer type door opening and closing the storage space, a lower receiving member connected to the drawer type door, the lower receiving member being withdrawn together with the drawer type door, an upper receiving member withdrawably disposed above the lower receiving member, and a restraint member disposed on the drawer type door, the restraint member being rotated according to a user's selection to selectively restrain the upper receiving member and to allow the upper receiving member to be selectively interlocked with the drawer type door, thereby selectively withdrawing the upper receiving member.

15 Claims, 12 Drawing Sheets

U.S. PATENT DOCUMENTS

2006/0207283 A1* 9/2006 Kim et al. ..... 62/407
2006/0232381 A1* 10/2006 Gauthier ..... 340/5.73
2007/0245762 A1* 10/2007 Maglinger et al. ..... 62/344
2008/0018215 A1* 1/2008 Carden et al. ..... 312/404
2008/0203875 A1* 8/2008 Lim et al. ..... 312/404
2009/0243454 A1* 10/2009 Yoo et al. ..... 312/405.1
2010/0219730 A1* 9/2010 Watts et al. ..... 312/404
2010/0236281 A1* 9/2010 Eom et al. ..... 62/449

* cited by examiner

[fig.1]
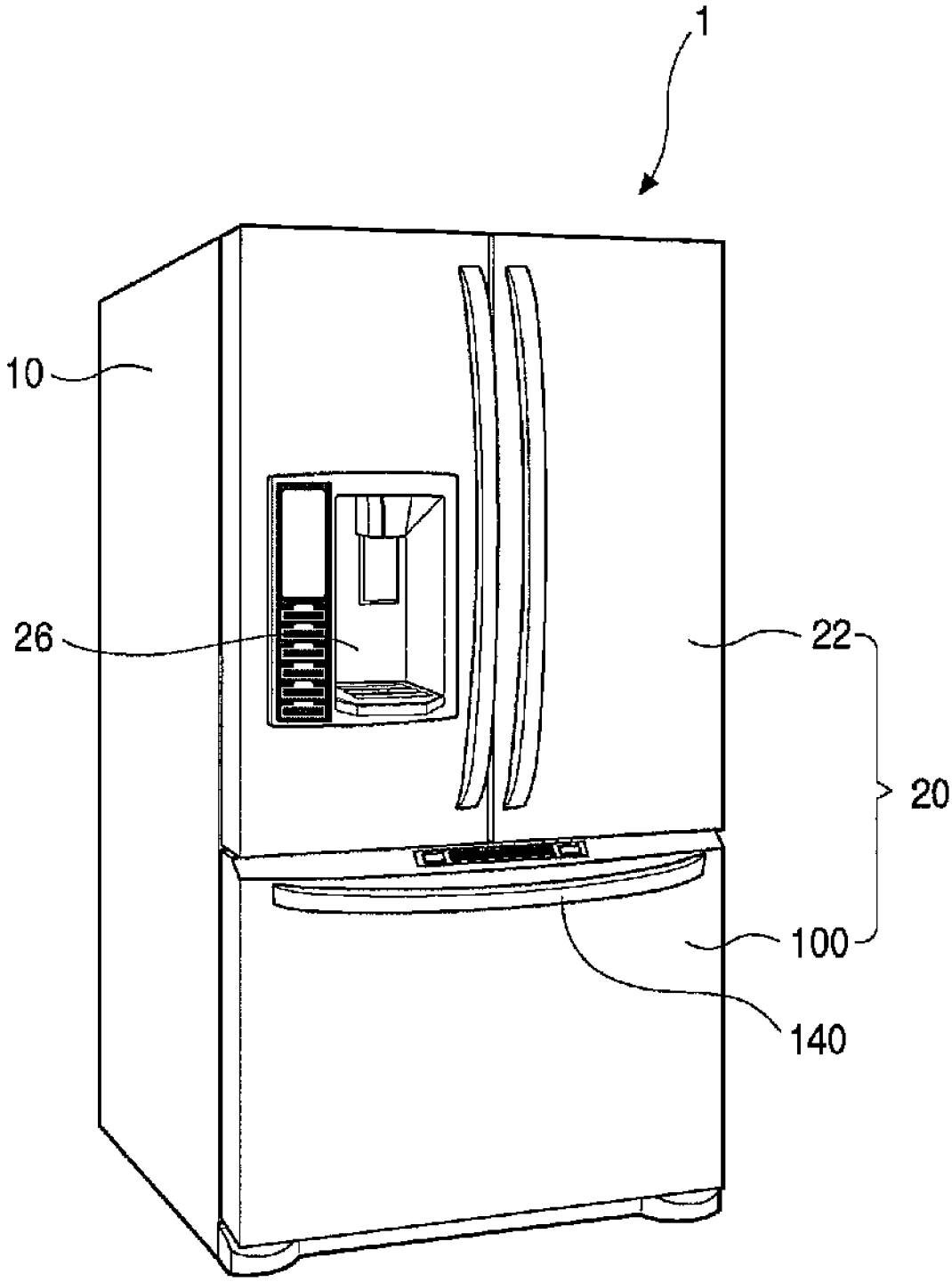

[fig.2]
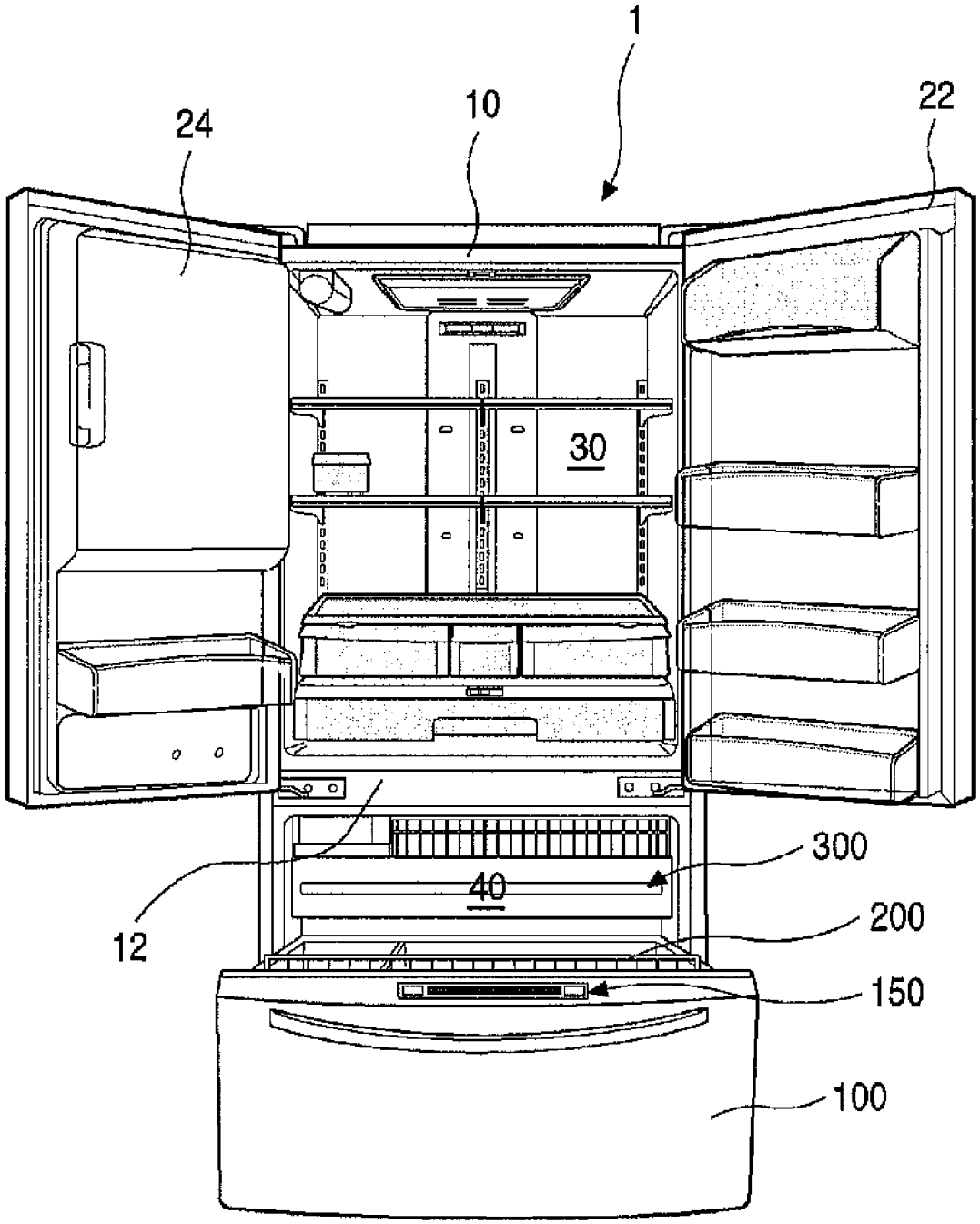

[fig.3]
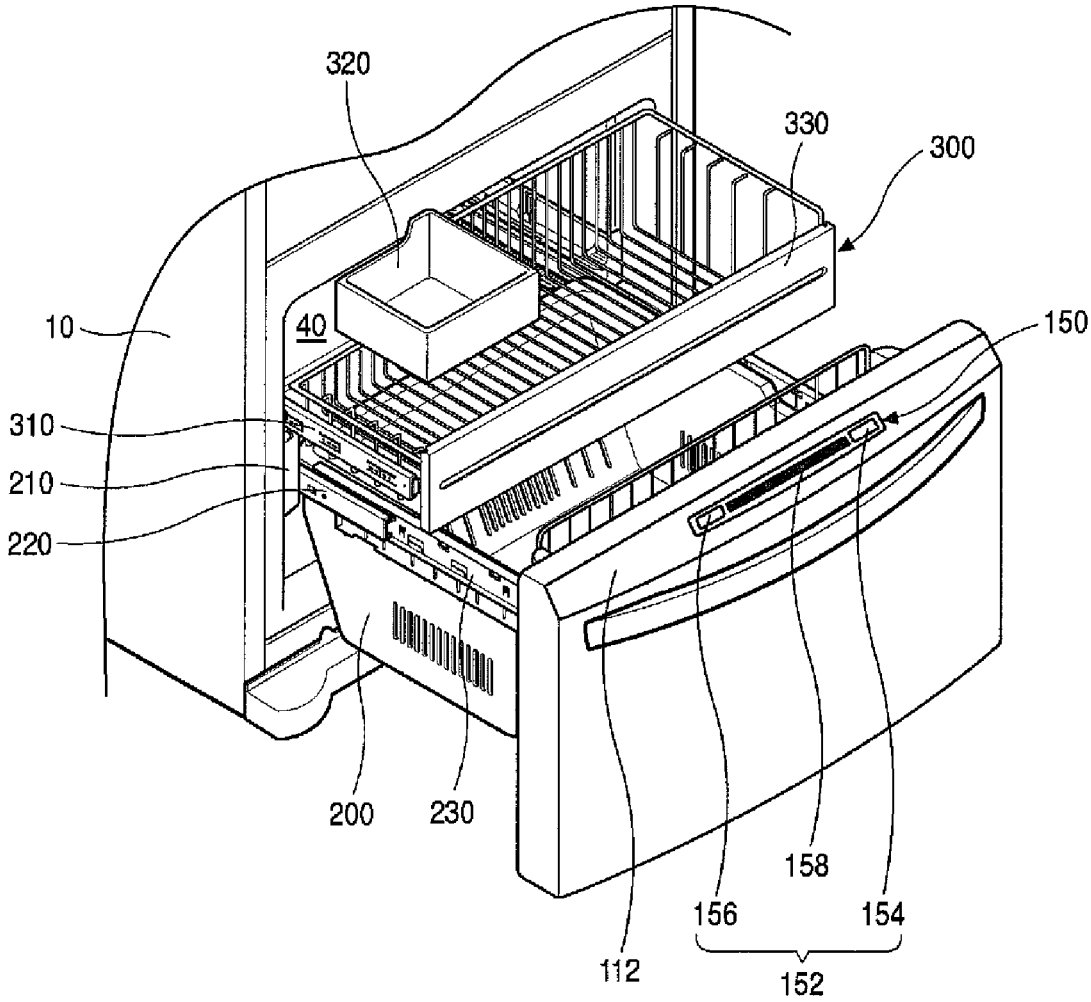

[fig.4]
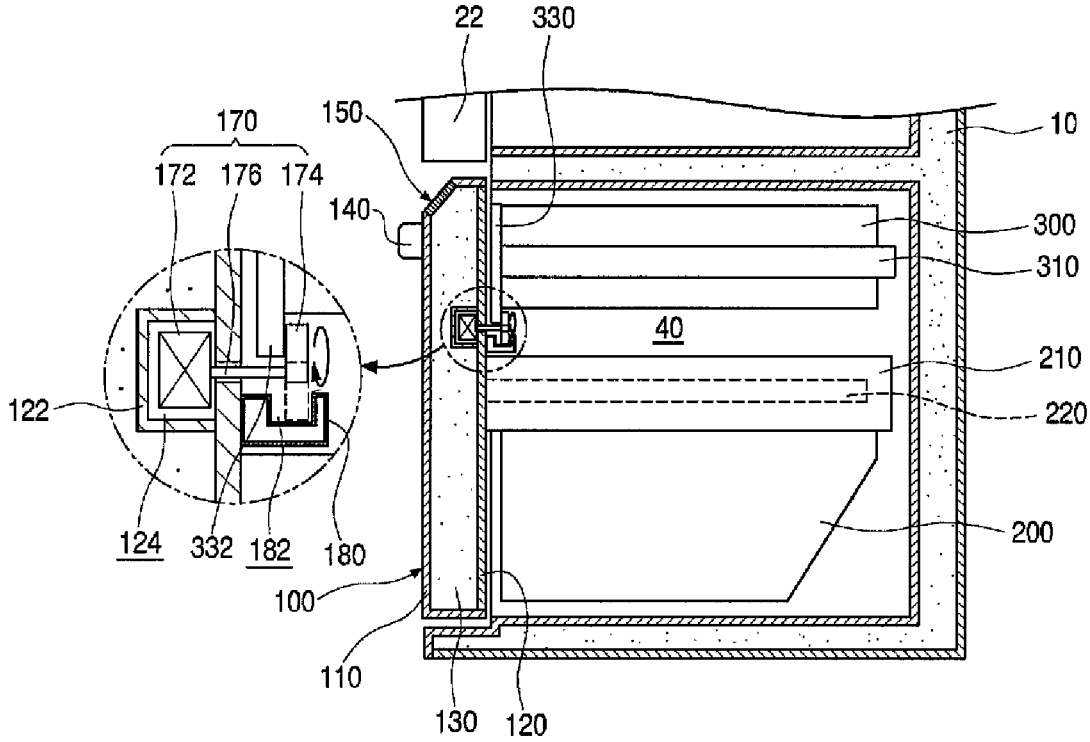

[fig.5]
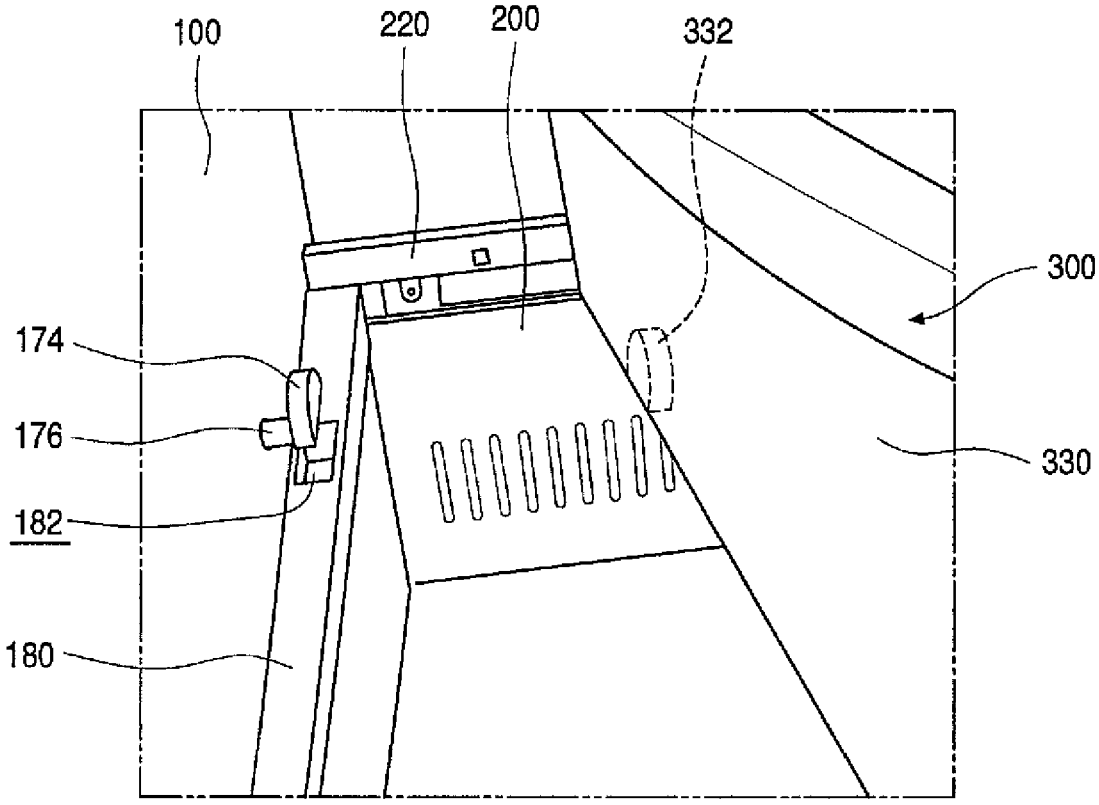

[fig.6]
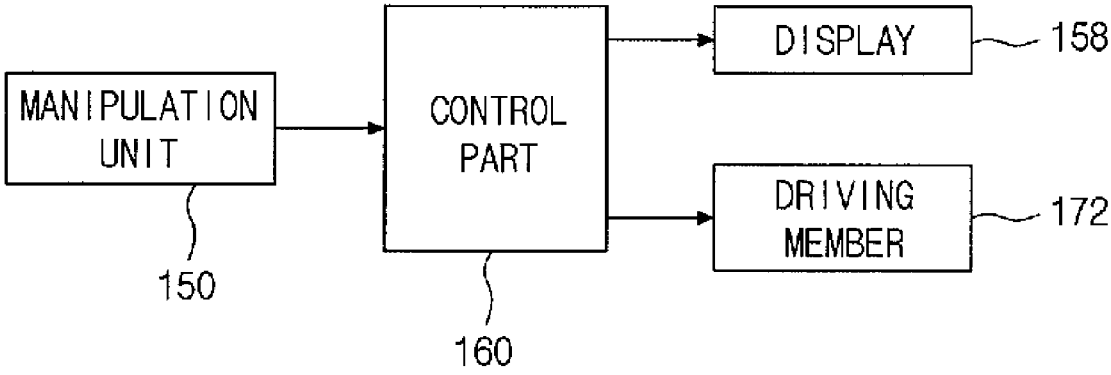

[fig.7]
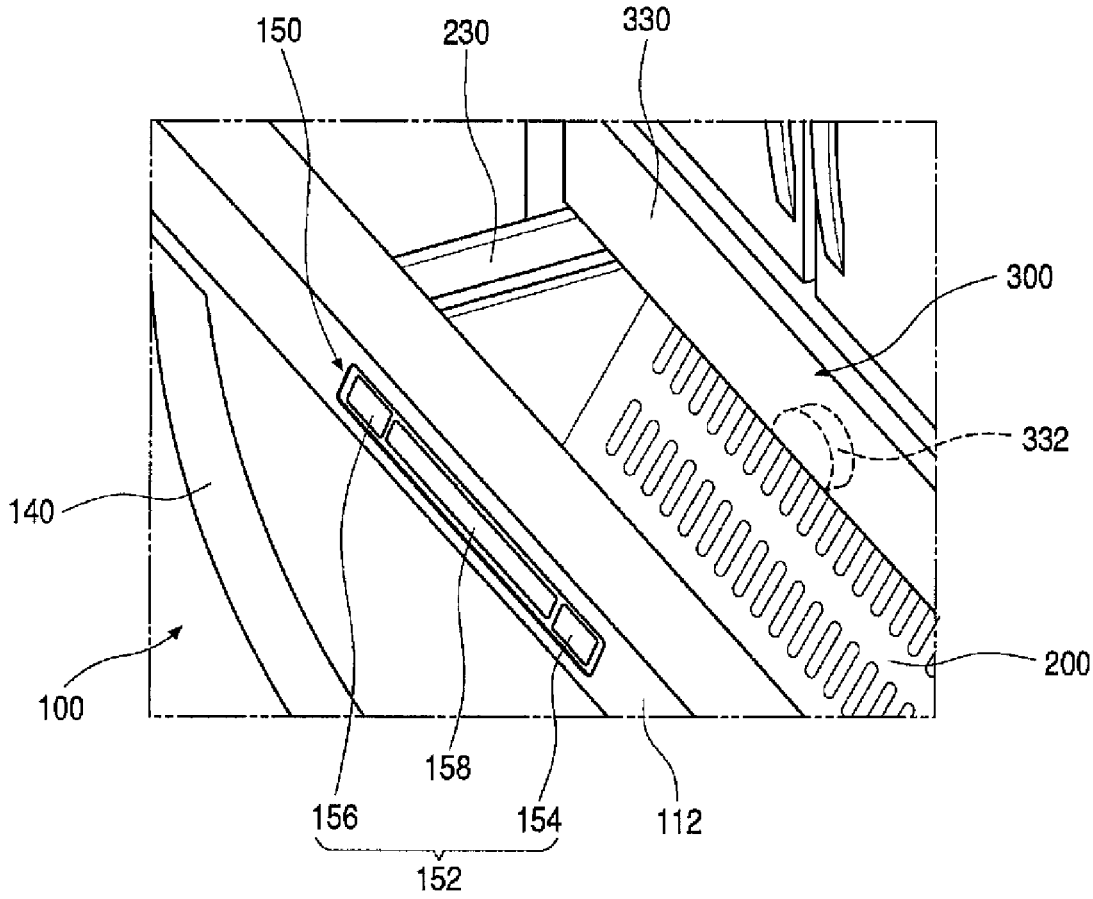

[fig.8]
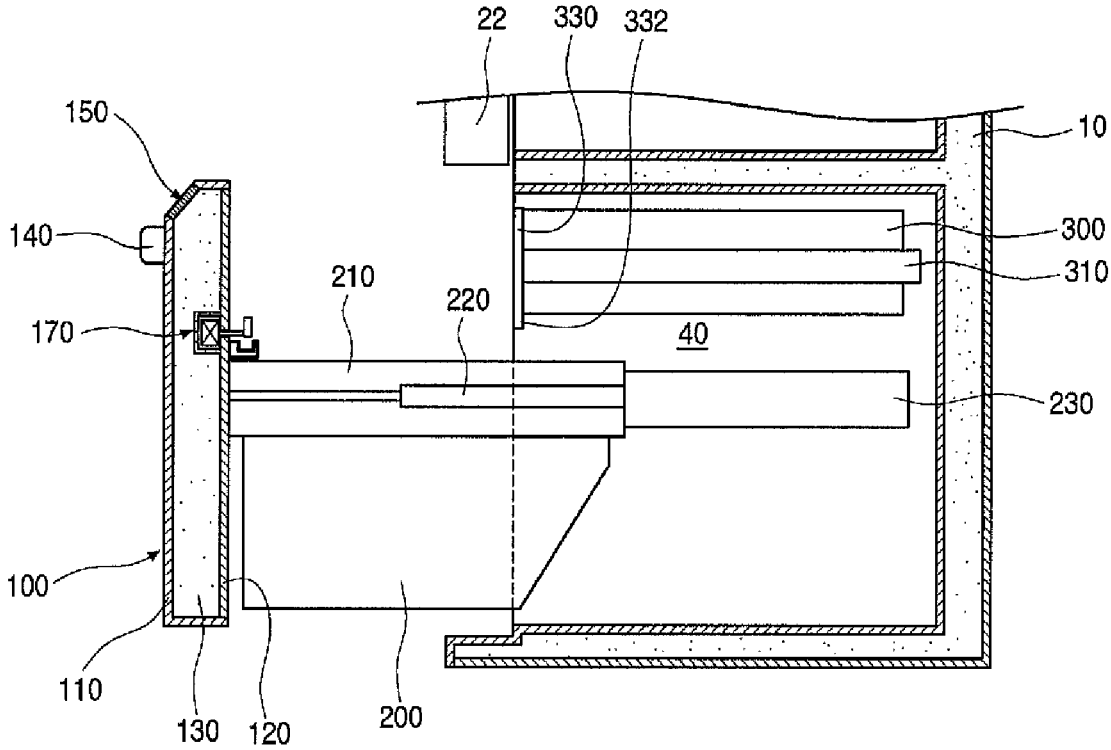

[fig.9]
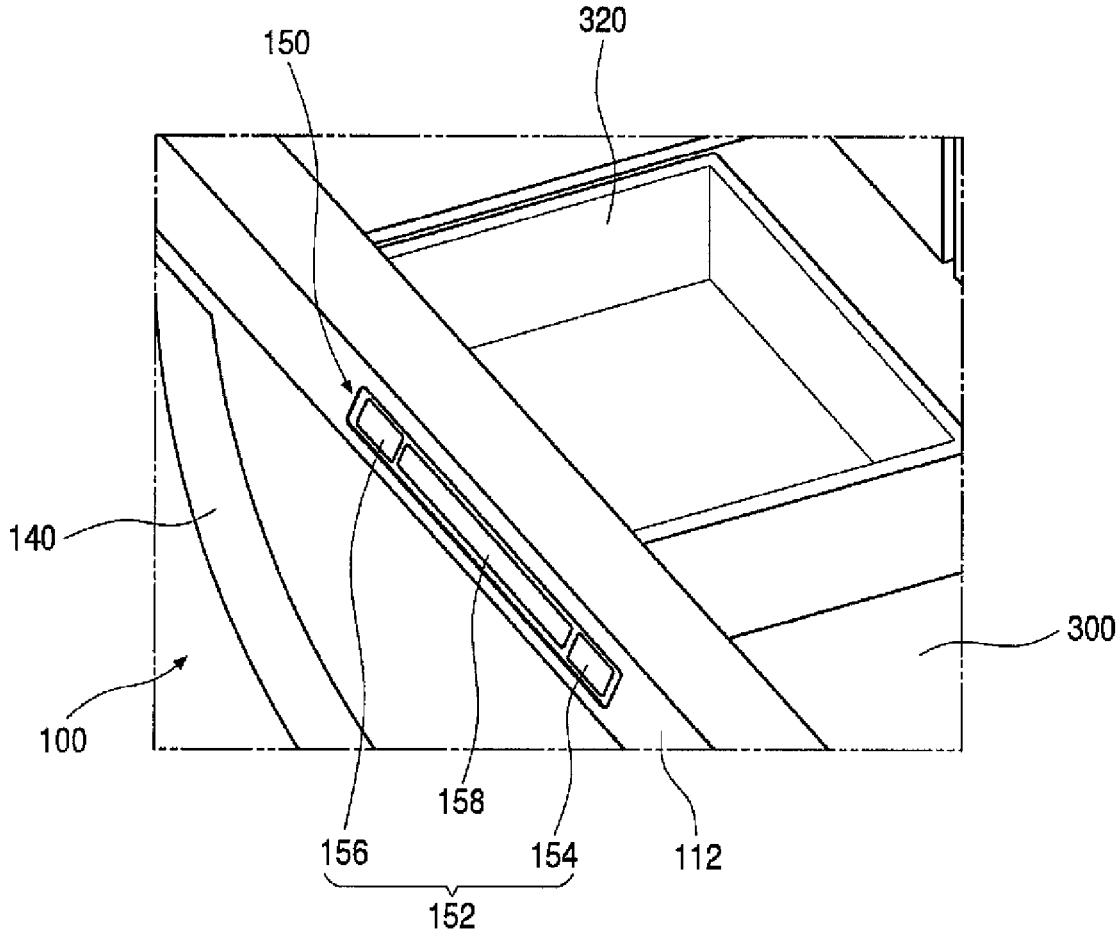

[fig.10]
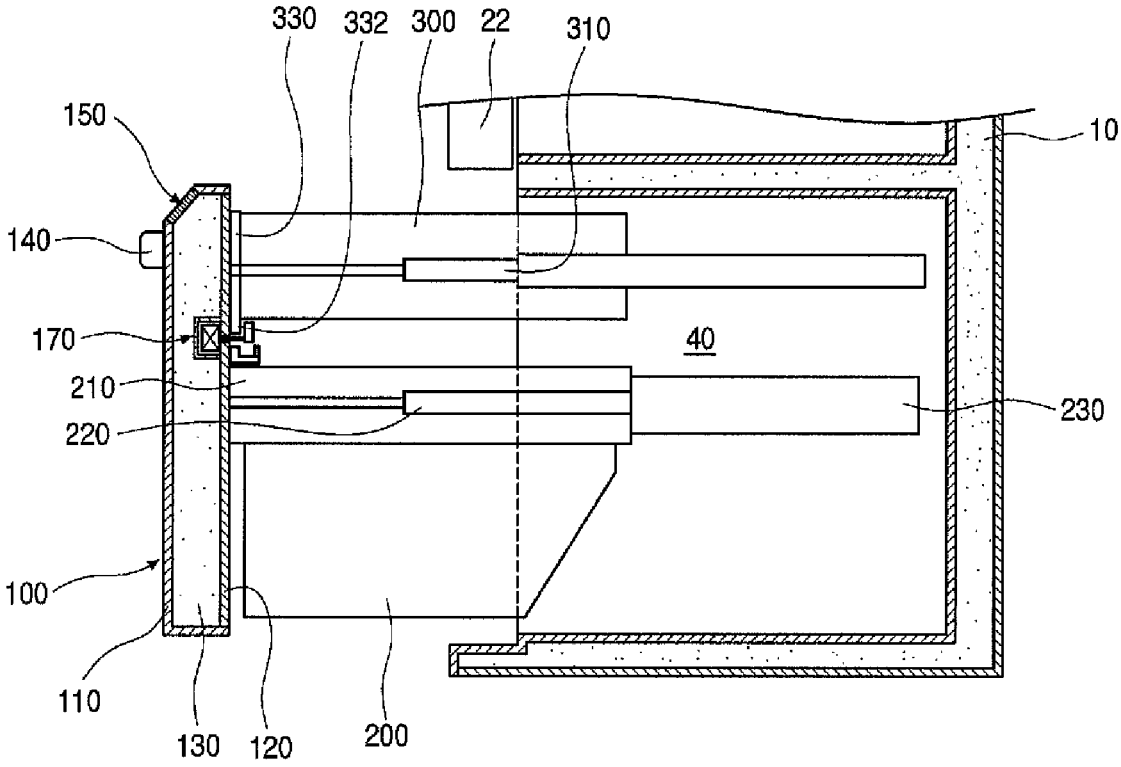

[fig.11]
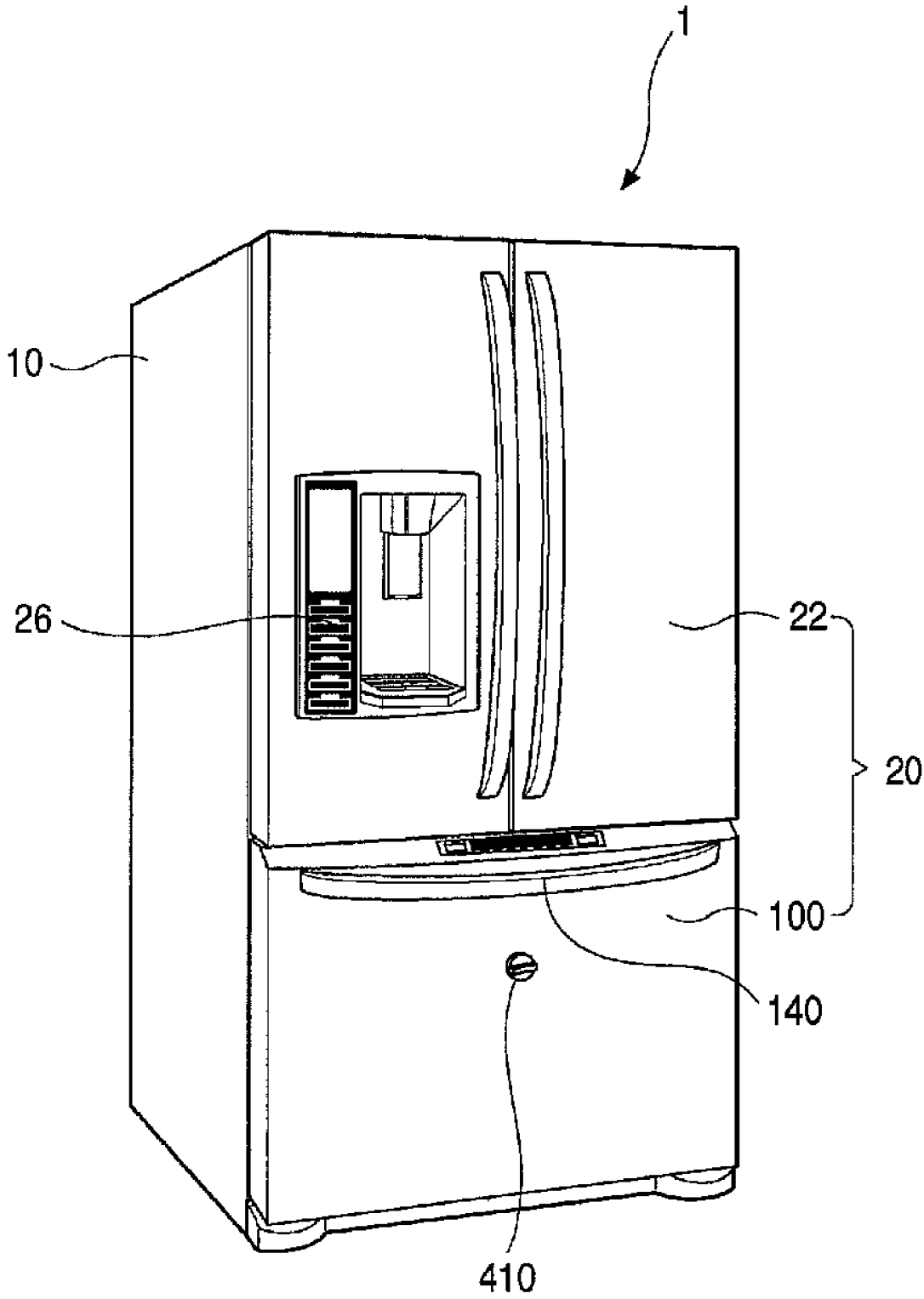

[fig.12]
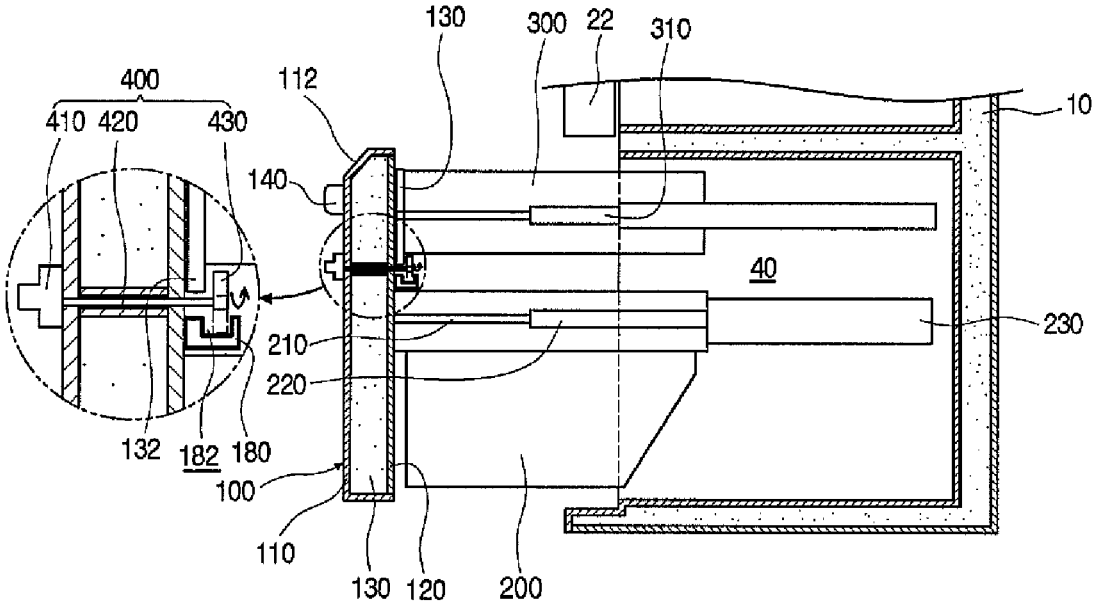

REFRIGERATOR

CROSS-REFERENCE TO RELATED APPLICATIONS

The present application claims priority under 35 U.S.C. 119 and 35 U.S.C. 365 to Korean Patent Application No. 10-2009-0061420 (7 Jul. 2009), which is hereby incorporated by reference in its entirety.

BACKGROUND

The present disclosure relates to a refrigerator.

Generally, a refrigerator is a home appliance, which stores foods in a storage space that is shielded by a refrigerator door in order to keep foods at low temperatures, and enables foods to be stored in a fresh state by cooling the inside of the storage space using cold air generated through heat exchange with refrigerant that circulates through a cooling cycle.

The storage space within the refrigerator is divided into a refrigerator compartment that is maintained at a temperature of about 1° C. to about 4° C. to store foods such as vegetables in a fresh state and a freezer compartment that is maintained at about 18° C. below zero to store foods such as meats and fishes in a frozen state. Various types of refrigerators may be provided according to an arrangement of the refrigerator compartment and the freezer compartment and configurations of refrigerator doors that cover the refrigerator compartment and the freezer compartment, respectively.

Due to changes in dietary life and well-being trends, consumers prefer larger, multi-functional refrigerators, and various convenient refrigerators have been introduced in the market.

SUMMARY

In one embodiment, a refrigerator includes: a cabinet defining a storage space; a drawer type door withdrawably disposed on the cabinet, the drawer type door opening and closing the storage space; a lower receiving member connected to the drawer type door, the lower receiving member being withdrawn together with the drawer type door; an upper receiving member withdrawably disposed above the lower receiving member; and a restraint member disposed on the drawer type door, the restraint member being rotated according to a user's selection to selectively restrain the upper receiving member and to allow the upper receiving member to be selectively interlocked with the drawer type door, thereby selectively withdrawing the upper receiving member.

In another embodiment, a refrigerator includes: a cabinet defining a storage space; a drawer type door withdrawably disposed on the cabinet, the drawer type door opening and closing the storage space; a lower receiving member disposed inside the storage space, the lower receiving member being withdrawn together with the drawer type door; an upper receiving member withdrawably disposed above the lower receiving member; a manipulation part disposed on the drawer type door, the manipulation part inputting a withdrawal of the receiving members withdrawn together with the drawer type door; a restraint unit disposed in the drawer type door, the restraint unit being rotated according to an input state of the manipulation part to selectively restrain the upper receiving member; and a control part electrically connected to the manipulation part and the restraint unit to control an operation of the restraint unit.

In further another embodiment, a refrigerator includes: a cabinet defining a storage space; a drawer type door withdrawably disposed on the cabinet, the drawer type door opening and closing the storage space; a lower receiving member disposed inside the storage space, the lower receiving member being withdrawn together with the drawer type door; an upper receiving member withdrawably disposed above the lower receiving member; and a restraint unit disposed on the drawer type door, the restraint member being rotated according to a user's selection to selectively restrain the upper receiving member and to selectively withdraw the drawer type door and the upper receiving member together with each other.

The details of one or more embodiments are set forth in the accompanying drawings and the description below. Other features will be apparent from the description and drawings, and from the claims.

BRIEF DESCRIPTION OF THE DRAWINGS

FIG. 1 is a perspective view of a refrigerator according to an embodiment.

FIG. 2 is a front view of a refrigerator with its doors open according to an embodiment.

FIG. 3 is a partially perspective view of a refrigerator with a drawer type door open according to an embodiment.

FIG. 4 is a schematic view of a freezer compartment with a drawer type door closed according to an embodiment.

FIG. 5 is a partially perspective view illustrating a back surface of a drawer type door and a lower receiving member according to an embodiment.

FIG. 6 is a block diagram illustrating a connection state between a manipulation part, a control part, and a restraint unit according to an embodiment.

FIG. 7 is a partially perspective view illustrating a withdrawn lower receiving member of a drawer type door according to an embodiment.

FIG. 8 is a schematic view illustrating a withdrawn lower receiving member of a drawer type door according to an embodiment.

FIG. 9 is a partially perspective view illustrating a withdrawn upper receiving member of a drawer type door according to an embodiment.

FIG. 10 is a schematic view illustrating a withdrawn upper receiving member of a drawer type door according to an embodiment.

FIG. 11 is a perspective view of a refrigerator according to another embodiment.

FIG. 12 is a schematic view illustrating a withdrawn upper receiving member of a drawer type door according to another embodiment.

DETAILED DESCRIPTION OF THE EMBODIMENTS

Reference will now be made in detail to the embodiments of the present disclosure, examples of which are illustrated in the accompanying drawings. However, the sprit of the present disclosure is not limited to the embodiments, and other embodiments by modifications, additions, and deletions of other element also fall on the sprit of the present disclosure.

While a bottom freezer type refrigerator including a freezer compartment at a lower side thereof is exemplarily described for the sake of descriptive convenience and ease of understanding, the present disclosure is applicable to any refrigerator provided with a drawer type door.

FIG. 1 is a perspective view of a refrigerator according to an embodiment, and FIG. 2 is a front view of a refrigerator with its doors open according to an embodiment.

Referring to FIGS. 1 and 2, a refrigerator 1 according to an embodiment includes a cabinet 10 defining a storage space therein and a door 20 opening and closing the storage space. An outer appearance of the refrigerator 1 is defined by the cabinet 10 and the door 20.

The inside of the cabinet 10 is vertically partitioned by a barrier 12 to define a refrigerator compartment 30 at an upper side thereof and a freezer compartment 40 at a lower side thereof. The door 20 includes a refrigerator compartment door 22 opening and closing the refrigerator compartment 30 and a freezer compartment door 100 opening and closing the freezer compartment 40.

The refrigerator compartment door 22 is provided in a pair on both sides of an opened front surface of the refrigerator compartment 30. The pair of doors 22 may be rotatably installed on the front surface of the refrigerator compartment 30 to cover the refrigerator compartment 30 by the rotation thereof.

A plurality of shelves, drawers, and baskets are disposed in the refrigerator compartment 30 and on a back surface of the refrigerator compartment door 22 to receive foods. An ice making chamber 24 in which an ice maker for making ice is received may be disposed in the refrigerator compartment door 22 as necessary. A dispenser 26 for dispensing drinking water and ice cubes to the outside may be disposed in a front surface of the refrigerator compartment door 22.

The freezer compartment door 100 is withdrawably installed on a front surface of the freezer compartment 40. The freezer compartment door 100 comes in and out to selectively cover the freezer compartment 40. Hereinafter, the freezer compartment door 100 is referred to as a drawer type door.

A plurality of receiving members 200 and 300 is disposed inside the freezer compartment 40. The plurality of receiving members 200 and 300 may selectively come in and out together with the drawer type door 100 according to the coming and going of the drawer type door 100.

FIG. 3 is a partially perspective view of a refrigerator with a drawer type door open according to an embodiment, FIG. 4 is a schematic view of a freezer compartment with a drawer type door closed according to an embodiment. FIG. 5 is a partially perspective view illustrating a back surface of a drawer type door and a lower receiving member according to an embodiment, and FIG. 6 is a block diagram illustrating a connection state between a manipulation part, a control part, and a restraint unit according to an embodiment.

Referring to FIGS. 3 to 5, the drawer type door 100 is withdrawably installed on the opened front surface of the freezer compartment 40.

In detail, door rail guides 210 are disposed respectively on inner left and right surfaces of the freezer compartment 40. A door rail assembly 220 extensible in multistage is disposed on each of the door rail guides 210. The door rail assemblies 220 are fixed to both left and right sides of a back surface of the drawer type door 100, respectively. Thus, the drawer type door 100 may be slidably moved in front and rear directions due to the door rail assemblies 220 to selectively cover the freezer compartment 40.

A mounting bracket 230 is disposed on each of the door rail assemblies 220 disposed on both left and right sides. The lower receiving member 200 is seated on the mounting bracket 230. The lower receiving member 200 may be integrally coupled to the door rail assembly 220 by the mounting bracket 230. Thus, when the drawer type door 100 is withdrawn, the lower receiving member 200 may be withdrawn together with the door rail assembly 220.

The foods are received in the lower receiving member 200. The lower receiving member 200 has a basket shape with an opened upper side. Also, the lower receiving member 200 has a size corresponding to that of a lower space of the freezer compartment 40. The inside of the lower receiving member 200 may be partitioned by a movable partition plate.

The upper receiving member 300 is disposed above the lower receiving member 200, i.e., in an inner upper portion of the freezer compartment 40. The upper receiving member 300 has a drawer shape with an opened upper side. The upper receiving member 300 has a height less than that of the lower receiving member 200.

The upper receiving member 300 is disposed inside the freezer compartment 40. Also, the upper receiving member 300 is withdrawable by drawer rail guides 310 disposed on both inner left and right surfaces of the freezer compartment 40 and door rail assemblies 220 disposed respectively on the drawer rail guides 310 and extensible in a multistage. The upper receiving member 300 may be selectively withdrawn together with the drawer type door 100 by a restraint unit 170 that will be described later.

An ice bin 320 for storing ice may be further provided inside the upper receiving member 300. Two upper receiving members 300 may be disposed on both left and right sides as necessary. Also, an ice maker (not shown) may be disposed at a side of the upper receiving member 300 as necessary, and the upper receiving member 300 may be disposed at a side of the ice maker.

The upper receiving member 300 may have an opened upper surface, and the rest surfaces of the upper receiving member 300 may have plate shapes, respectively. The upper receiving member 300 may be formed of a wire material as necessary.

A front surface plate 330 defining an outer appearance of a front surface of the upper receiving member 300 is disposed on the front surface of the upper receiving member 300. A hook part 332 is disposed at a lower end of the front surface plate 330. The hook part 332 further protrudes downward from a bottom surface of the upper receiving member 300 to interfere with the restraint unit 170. The hook part 332 may have a depressed shape as necessary such that a portion of the restraint unit 170 is selectively received to interfere with the hook part 332.

The drawer type door 100 includes an outer case 110 having a front surface and a circumference surface to define an outer appearance thereof, a door liner 120 defining a configuration of a back surface thereof, and a heat insulator 130 disposed between the outer case 110 and the door liner 120.

A door handle 140 to be grasped by a user is disposed on an upper portion of the front surface of the door 20. An inclined surface 112 is disposed above the door handle 140, i.e., on an edge portion at which the front surface of the door 20 contacts a top surface of the door 20.

A manipulation part 150 for manipulating the restraint unit 170 is disposed on the inclined surface 112. The manipulation part 150 includes a manipulation button 152 inputted by the user and a display 158 for displaying a stat according to an input operation of the manipulation button 152.

In detail, the manipulation button 152 may include a select button 154 and a lock button 156. The select button 154 may adjust an operation of the restraint unit 170 according to a user's manipulation. The receiving members 200 and 300 withdrawable together with the drawer type door 100 may be selected by the operation of the restraint unit 170. The lock button 154 may maintain the operation state of the restraint unit 170 selected by the manipulation button 152.

The display 158 displays the operation state of the restraint unit 170 selected by the manipulation button 152. The user may confirm states of the receiving members 200 and 300 withdrawable together with the drawer type door 100 through the display 158. The display 158 may not be disposed on the manipulation part 150. Another confirmation unit in which sound is outputted or a lamp is turned on may be provided instead of the display 158.

The manipulation part 150 may be integrated with a control part 160. The control part 160 controls operations of the manipulation button 152, the display 158, and the restraint unit 170. The control part 160 may be integrated with the manipulation part 150 and disposed inside the drawer type door 100.

The control part 160 may be spaced from the manipulation part 150 and disposed in a side of the inside of the drawer type door 100. Also, the control part 160 may be integrated with the restraint unit 170. The control part 160 is electrically connected to the manipulation part 150 and the restraint unit 170.

The manipulation part 150 and the control part 160 may be disposed on a position adjacent to the dispenser 16 disposed on the front surface of the refrigerator compartment door 22 as necessary. In this case, a wire connected to the restraint unit 170 within the drawer type door 100 may be guided through the door rail assembly 220.

An inwardly depressed restraint unit mounting part 124 is defined in the back surface of the door 20. The restraint unit mounting part 124 defines a space by a plastic injection molded mounting part case 122. The restraint unit mounting part 124 may allow the restraint unit 170 to be fixedly installed inside the mounting part case 122. Thus, the restraint unit 170 may be disposed inside the heat insulator 130 of the drawer type door 100.

The restraint unit 170 may be withdrawable together with the upper receiving member 300 when the drawer type door 100 is withdrawn to selectively restrain the upper receiving member 300. The restraint unit 170 may be operated by the manipulation of the manipulation part 150.

The restraint unit 170 includes a driving member 172 and a restraint member 174. The driving member 172 provides a power for operating the restraint member 174. An electric motor such as a general stepping motor may be used as the driving member 172.

The driving member 172 is disposed inside the drawer type door 100, i.e., the mounting part case 122. A rotation shaft 176 of the driving member 172 protrudes outwardly from the back surface of the drawer type door 100. The restraint member 174 is disposed on an end of the rotation shaft 176.

The rotation shaft 176 and the restraint member 174 may be directly connected to each other, and as necessary, the rotation shaft 176 may be interlocked with the restraint member 174 through a gear coupling or a link coupling.

The restraint member 174 is rotated together with the rotation shaft 176 when the rotation shaft 176 is rotated. The restraint member 174 is eccentrically disposed from the rotation shaft 176 in one direction. For example, the restraint member 174 may have a semicircular shape. Also, the rotation shaft 176 may be coupled to an approximately central portion of a diameter of the restraint member 174.

Thus, whenever rotation shaft 176 is rotated at about 180°, a protrusion direction of the restraint member 174 is reversely changed. As a result, the restraint member 174 may selectively interfere with the upper receiving member 300.

The restraint member 174 may have a different shape protruding in a direction except the semicircular shape. Also, the restraint member 174 may have various shapes that can selectively restrain the upper receiving member 300 by the rotation thereof.

The rotation shaft 176 may extend to protrude from the back surface of the drawer type door 100 by a predetermined distance. The restraint member 174 is disposed on the end of the rotation shaft 176 and rotated in a state where the restraint member 174 is spaced from the back surface of the drawer type door 100.

In detail, the restraint unit 170 is disposed in a position of the drawer type door 100 corresponding to a downward direction of the upper receiving member 300. The restraint member 174 is rotated below the upper receiving member 300.

When the drawer type door 100 is closed, the hook part 332 of the upper receiving member 300 is disposed between the back surface of the drawer type door 100 and the restraint member 174. The upper receiving member 300 and the hook part 332 selectively interfere with each other according to the rotation of the restraint member 174 to selectively restrain the upper receiving member 300.

A door frame 180 is disposed below the restraint member 174. The door frame 180 is horizontally disposed at a rear direction of the restraint member 174. Both ends of the door frame 180 may be coupled to the door rail assemblies 220 disposed both ends or left and right sides of the drawer type door 100, respectively.

An avoidance part 182 depressed or opened downward may be further defined in an approximately central portion of the door frame 180, i.e., a position corresponding to the restraint member 174. The avoidance part 182 may receive the protruding portion of the restraint member 174 when the restraint member 174 is rotated. Thus, it may prevent the restraint member 174 from being damaged by interfering with the foods when the foods are received into the lower receiving member 200.

In detail, the door frame 180 is disposed below a position adjacent to the rotation shaft 176 of the driving member 172. Also, the avoidance part 182 depressed by a depth greater than a radius of the restraint member 174 or opened downward is disposed at the approximately central portion of the door frame 180. Thus, when the restraint member 174 is rotated so that the protruding portion of the restraint member 174 faces a downward direction, the most part of the restraint member 174 is received inside the avoidance part 182.

In addition, the door frame 180 may connect the door rail assemblies 220 disposed both left and right sides to each other to prevent the drawer type door 100 from being twisted or shaken when the drawer type door 100 is withdrawn.

A front end of the lower receiving member 200 may be seated on the door frame 180 when the lower receiving member 200 is installed.

Also, a portion of the back surface of the drawer type door 100 may protrude backward to form the door frame 180. At this time, only a portion of the back surface of the drawer type door 100 corresponding to the restraint member 174 may protrude backward to form the door frame 180.

Hereinafter, a process of opening and closing the drawer type door of the refrigerator including the above-described components will be described in detail with reference to accompanying drawings.

FIG. 7 is a partially perspective view illustrating a withdrawn lower receiving member of a drawer type door according to an embodiment, and FIG. 8 is a schematic view illustrating a withdrawn lower receiving member of a drawer type door according to an embodiment.

Referring to FIGS. 7 and 8, in a state where the drawer type door 100 is closed, a user performs manipulation for withdrawing one of the upper receiving member 300 and the lower receiving member 200.

When the user desires that only the lower receiving member 200 is withdrawn, the user pushes the select button to become in a state in which the lower receiving member 200 is selected. At this time, the display 158 displays the state selected by the user, and the user may confirm the selected state through the display 158.

Then, the state in which the lower receiving member 200 is selected is maintained, and then, the lock button 156 for preventing the selected state from being changed due to a mis-operation is manipulated to prevent the selected state from being changed into an undesired state.

When the select button 154 is pushed, the control part 160 operates the restraint unit 170.

In detail, when the selected state of the lower receiving member 200 is determined by the select button 154, the driving member 172 is operated under the control of the control part 160. When the rotation shaft 176 is rotated by the operation of the driving member 172, the restraint member 174 is rotated also.

The restraint member 174 should not interfere with the upper receiving member 600 in a state where the lower receiving member 200 is selected. Thus, the protruding portion of the restraint member 174 faces the downward direction. At this time, as shown in FIG. 8, the restraint member 174 becomes in a state in which the restraint member 174 is received into the avoidance part 182 of the door frame 180.

When the user confirms that the lower receiving member 200 is selected through the display 158, the user grasps the door handle 140 of the drawer type door 100 to pull the door handle 140 in a front direction. As a result, the drawer type door 100 is slidingly withdrawn to open the freezer compartment 40.

Since the door rail assembly 220 extends to slidingly withdraw the drawer type door 100 in the front direction, the drawer type door 100 may be supported by the door rail assembly 220.

When the drawer type door 100 is forwardly withdrawn, the lower receiving member 200 disposed on the drawer type door 100 may be slidingly withdrawn also together with the drawer type door 100. Thus, the opened upper surface of the lower receiving member 200 is exposed to the outside due to the withdrawal of the lower receiving member 200 to receive the foods.

At this time, the upper receiving member 30 is maintained in the inserted state. In this state, the front surface plate 330 of the upper receiving member 300 pulls out to open the upper receiving member 300.

After the foods are received into the lower receiving member 200, the drawer type door 100 is pushed, and thus slidingly moved in a rear direction. As the drawer type door 100 is slidingly moved in the rear direction, the lower receiving member 200 is inserted together with the drawer type door 100.

FIG. 9 is a partially perspective view illustrating a withdrawn upper receiving member of a drawer type door according to an embodiment, and FIG. 10 is a schematic view illustrating a withdrawn upper receiving member of a drawer type door according to an embodiment.

Referring to FIGS. 9 and 10, in a state where the drawer type door 100 is closed, the user manipulates the manipulation part 150 to withdraw the upper receiving member 300 together with the drawer type door 100 when the drawer type door 100 is opened.

The user pushes the select button 154 to select the upper receiving member 300. The control part 160 operates the restraint unit 170 according to the selection of the select button 154 to become in a state in which the upper receiving member 300 and the drawer type door 100 are restrained against each other.

In detail, when the driving member 172 is rotated according to a command of the control part 160, the restraint member 174 coupled to the rotation shaft 176 is rotated also. Here, the protruding portion of the restraint member 174 is rotated upward to restrain a front end of the upper receiving member 300.

As shown in FIG. 10, the restraint member 174 is disposed inside the hook part 332 of the upper receiving member 300 due to the rotation thereof. Thus, the front end of the upper receiving member 300 is hooked and restrained between the back surface of the drawer type door 100 and the restraint member 174.

In this state, the user confirms the selected state of the upper receiving member 300 through the display 158. Then, the user pulls the door handle 140 to open the drawer type door 100. When the door handle 140 is pulled out, the door rail assembly 220 extends in a front direction at the same time to guide the sliding withdrawal of the drawer type door 100.

Simultaneously, the upper receiving member 300 is pulled out in the front direction by the restraint member 174. As a result, the door rail assembly 220 may extend in the front direction. Thus, the upper receiving member 300 may be slidingly withdrawn together with the drawer type door 100.

The opened upper surface of the upper receiving member 300 may be exposed to the outside due to the withdrawal of the drawer type door 100 to easily receive the foods within the upper receiving member 300.

In this state, the user receives the foods into the upper receiving member 300. After the foods are received into the upper receiving member 300, the drawer type door 100 is closed. At this time, the upper receiving member 300 is inserted into the freezer compartment 40 together with the drawer type door 100 in a state where the upper receiving member 300 is restrained against the drawer type door 100.

When the upper receiving member 300 or the lower receiving member 200 is maintained in a state in which it is impossible to change its selected state, or the selected state of the upper receiving member 300 or the lower receiving member 200 is converted into a changeable state, the lock button 156 is pushed and manipulated.

The refrigerator including the above-described components according to the present disclosure may be implemented in various embodiments except the previously described embodiment. Hereinafter, another embodiment of the present disclosure will be described with reference to accompanying drawings.

FIG. 11 is a perspective view of a refrigerator according to another embodiment, and FIG. 12 is a schematic view illustrating a withdrawn upper receiving member of a drawer type door according to another embodiment.

According to this embodiment, an upper receiving member is selectively restrained by a restraint unit that is directly manipulated by a user to selectively withdraw the upper receiving member together with a drawer type door when the drawer type door is withdrawn. Also, the same components in this embodiment will be designated with the same reference numeral as those used in the previously described embodiment, and the description with respect thereto will be omitted.

Referring to FIGS. 11 and 12, a freezer compartment 40 is opened and closed by a drawer type door 100. The drawer type door 100 is fixed inside the freezer compartment 40 by a door rail assembly 220. The drawer type door 100 is withdrawably installed according to the extension of the door rail assembly 220.

A mounting bracket 230 in which the lower receiving member 200 is disposed on the door rail assembly 220 is disposed in a rear direction of the drawer type door 100, and thus slidingly withdrawn together with the drawer type door 100 when the drawer type door 100 is withdrawn. An upper receiving member 300 is disposed above the lower receiving member 200.

The upper receiving member 300 is withdrawably installed inside the freezer compartment 40 by the door rail assembly 220. Also, the upper receiving member 300 is selectively withdrawn together with the drawer type door 100 by manipulation of a manipulation member 410 that will be described later.

The drawer type door 100 includes an outer case 110 defining a front surface and a circumference surface thereof, a door liner 120 defining a back surface thereof, and a heat insulator 130 filled between the outer case 110 and the door liner 120. A door handle 140 is disposed on the front surface of the drawer type door 100.

A restraint unit 400 is disposed in the drawer type door 100. The restraint unit 400 is disposed in the drawer type door 100 corresponding between the upper receiving member 300 and the lower receiving member 200 to pass through the drawer type door 100.

The restraint unit 400 includes a manipulation member 410 rotatably manipulated by a user, a transmission member 420 extending and passing through the drawer type door 100 at a rotation center of the manipulation member 410, and a restraint member 430 selectively restraining the upper receiving member 300 at an end of the transmission member 420.

The manipulation member 410 is disposed on the front surface of the drawer type door 100 and may be rotatably manipulated by the user. The manipulation member 410 is configured to display a rotation state thereon or on the front surface of the drawer type door 100 on which the manipulation member 410 is disposed to inform the rotation state to the user.

The transmission member 420 is connected to the rotation center of the manipulation member 410, and thus is rotated together with the manipulation member 410 when the manipulation member 410 is rotated. Also, the transmission member 420 passes through the drawer type door 100 to protrudingly extend in a rear direction of the drawer type door 100. The restraint member 430 is coupled to the end of the transmission member 420. Also, the end of the transmission member 420 may extend to couple the restraint member 430 to the back surface of the drawer type door 100 in a state where the restraint member 430 is spaced somewhat from the back surface of the drawer type door 100.

The restraint member 430 may laterally protrude from the end of the transmission member 420. When the restraint member 430 has a semicircular shape, the end of the transmission member 420 is coupled to a central portion of a diameter of the restraint member 430.

Thus, the transmission member 420 and the restraint member 430 are rotated by the rotation of the manipulation member 410. Also, the protruding portion of the restraint member 430 is disposed at an upper or lower portion thereof according to its rotation operation to selectively restrain the upper receiving member 300.

In detail, a front lower end of the upper receiving member 300 extends and is disposed between the back surface of the drawer type door 100 and the restraint member 430 when the drawer type door 100 is completely closed. Thus, a hook part 332 of the upper receiving member 300 may be selectively restrained according to the rotation state of the restraint member 430.

The front lower end of the upper receiving member 300 may extend to form the hook part 332, or a portion of the front lower end of the upper receiving member 300 may be upwardly depressed to form the hook part 332, thereby selectively receiving the restraint member 430.

A door frame 180 may be disposed in a rear direction of the drawer type door 100 corresponding to a downward direction of the restraint member 430. An avoidance part 182 may be further disposed on the door frame 180. When the restraint member 430 is rotated, the avoidance part 182 selectively receives the restraint member 430.

The manipulation member 410 may be disposed on a front surface of the drawer type door 100 corresponding to a front direction of the restraint member 430. Also, the manipulation member 410 may be disposed on an inclined surface (see reference numeral 112 of FIG. 3) or at a side adjacent to the door handle 140. At this time, the transmission member 420 may be gear-coupled or link-coupled to the manipulation member 410 and the restraint member 430 to selectively rotate the restraint member 430.

In the refrigerator according to the embodiments, the receiving members disposed inside the storage space of the refrigerator may be withdrawable together with the drawer type door according to the user's selection when the drawer type door is withdrawn.

Thus, since only manipulation for selecting a desired receiving member in order to open the upper receiving member or lower receiving member desired by the user and manipulation for withdrawing the drawer type door are performed to withdraw the selected receiving member, convenience of use may be improved.

In addition, since the foods may be withdrawn from the desired receiving member without performing separate manipulation for withdrawing a specific receiving member after the drawer type door is opened, the total time for opening the drawer type door may be reduced to improve power consumption efficiency.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet defining a storage space;

a barrier that vertically partitions the cabinet to define a refrigerating compartment at an upper side of the barrier and a freezing compartment at a lower side of the barrier;

at least one refrigerating compartment door provided at a front surface of the refrigerating compartment and rotatably installed at the front surface of the refrigerating compartment to cover at least a portion of the refrigerating compartment by rotation thereof;

a drawer type door withdrawably disposed on a front surface of the freezing compartment, the drawer type door opening and closing the freezing compartment;

a lower receiving member disposed inside the freezing compartment and connected to the drawer type door, the lower receiving member being withdrawn together with the drawer type door;

an upper receiving member withdrawably disposed inside the freezing compartment above the lower receiving member;

a driving member disposed inside the drawer type door;

a rotation shaft of the driving member that protrudes outwardly from a back surface of the drawer type door, the rotation shaft being rotated based on power provided by the driving member disposed inside the drawer type door;

a restraint member disposed on an end of the rotation shaft, the restraint member being rotated together with the rotation shaft when the rotation shaft is rotated and being eccentrically disposed from the rotation shaft in one direction to define a protruding portion of the restraint member, a door frame disposed below the restraint member; and an avoidance part defined within the door frame, wherein the driving member is configured to, based on user selection of the lower receiving member, rotate the rotation shaft to a position in which the protruding portion of the restraint member does not interfere with the upper receiving member, thereby allowing the drawer type door to be withdrawn without the upper receiving member, wherein the driving member is configured to, based on user selection of the upper receiving member, rotate the rotation shaft to a position in which the protruding portion of the restraint member restrains the upper receiving member and causes the upper receiving member to be withdrawn with the drawer type door wherein the protruding portion of the restraint member is positioned within the avoidance part when the rotation shaft is rotated to the position in which the protruding portion of the restraint member does not interfere with the upper receiving member, wherein the rotation shaft protrudes outwardly from the back surface of the drawer type door by a predetermined distance, wherein the restraint member is spaced from the back surface of the drawer type door, and wherein a bottom part of a front end of the upper receiving member is hooked and restrained between the back surface of the drawer type door and the protruding portion of the restraint member when the rotation shaft is rotated to the position in which the protruding portion of the restraint member restrains the upper receiving member.

2. The refrigerator according to claim 1, wherein the restraint member perpendicularly protrudes in a direction with respect to the rotation shaft.

3. The refrigerator according to claim 1, wherein the restraint member is disposed between the upper receiving member and the lower receiving member.

4. The refrigerator according to claim 1, further comprising a hook part downwardly extending to selectively interfere with the restraint member according to the rotation of the restraint member at the bottom part of the front end of the upper receiving member.

5. The refrigerator according to claim 1, further comprising a hook part depressed to selectively receive the upper receiving member according to the rotation of the restraint member and to interfere with the upper receiving member at the bottom part of the front end of the upper receiving member.

6. A refrigerator comprising:

a cabinet defining a storage space;

a drawer type door withdrawably disposed on the cabinet, the drawer type door opening and closing the storage space;

a lower receiving member disposed inside the storage space, the lower receiving member being withdrawn together with the drawer type door;

an upper receiving member withdrawably disposed above the lower receiving member;

a manipulation part disposed on the drawer type door, the manipulation part inputting a withdrawal of the receiving members withdrawn together with the drawer type door wherein the manipulation part comprises:

a manipulation button for selecting one of the upper receiving member and the lower receiving member, and a display on which a selected state of the upper receiving member or the lower receiving member selected by the manipulation button is displayed;

a restraint unit disposed in the drawer type door, the restraint unit being rotated according to an input state of the manipulation part to selectively restrain the upper receiving member;

a control part electrically connected to the manipulation part and the restraint unit to control an operation of the restraint unit;

a freezer compartment door selectively opening and closing by the rotation thereof on the cabinet a door frame disposed below the restraint unit; and an avoidance part defined within the door frame, wherein the restraint unit comprises:

a driving member disposed inside the drawer type door, a rotation shaft of the driving member that protrudes outwardly from a back surface of the drawer type door, the rotation shaft being rotated based on power provided by the driving member disposed inside the drawer type door, and a restraint member disposed on an end of the rotation shaft, the restraint member being rotated together with the rotation shaft when the rotation shaft is rotated and being eccentrically disposed from the rotation shaft in one direction to define a protruding portion of the restraint member, wherein the protruding portion of the restraint member is positioned within the avoidance part when the rotation shaft is rotated to a position in which the protruding portion of the restraint member does not interfere with the upper receiving member, wherein the rotation shaft protrudes outwardly from the back surface of the drawer type door by a predetermined distance, wherein the restraint member is spaced from the back surface of the drawer type door, wherein a bottom part of a front end of the upper receiving member is hooked and restrained between the back surface of the drawer type door and the protruding portion of the restraint member when the rotation shaft is rotated to a position in which the protruding portion of the restraint member restrains the upper receiving member, and, wherein the manipulation part is disposed on a dispenser disposed on the freezer compartment door.

7. The refrigerator according to claim 6, wherein the restraint member protrudes toward a side of a direction perpendicular to that of the rotation shaft.

8. The refrigerator according to claim 7, wherein the restraint unit is buried inside the drawer type door to allow an end of the rotation shaft and the restraint member to protrude to the outside.

9. The refrigerator according to claim 6, wherein the drawer type door further comprises a mounting part case disposed in a heat insulator therein to receive the restraint unit.

10. A refrigerator comprising:

a cabinet defining a storage space;

a barrier that vertically partitions the cabinet to define a refrigerating compartment at an upper side of the barrier and a freezing compartment at a lower side of the barrier;

at least one refrigerating compartment door provided at a front surface of the refrigerating compartment and rotatably installed at the front surface of the refrigerating compartment to cover at least a portion of the refrigerating compartment by rotation thereof;

a drawer type door withdrawably disposed on a front surface of the freezing compartment, the drawer type door opening and closing the freezing compartment;

a lower receiving member disposed inside the freezing compartment, the lower receiving member being withdrawn together with the drawer type door;

an upper receiving member withdrawably disposed inside the freezing compartment above the lower receiving member;

a driving member disposed inside the drawer type door;

a rotation shaft of the driving member that protrudes outwardly from a back surface of the drawer type door, the rotation shaft being rotated based on power provided by the driving member disposed inside the drawer type door;

a restraint member disposed on an end of the rotation shaft, the restraint member being rotated together with the rotation shaft when the rotation shaft is rotated and being eccentrically disposed from the rotation shaft in one direction to define a protruding portion of the restraint member;

a manipulation part that enables a user to select the upper receiving member to indicate a desire that the upper receiving member be withdrawn with the drawer type door or to select the lower receiving member to indicate a desire that the lower receiving member be withdrawn with the drawer type door without the upper receiving member;

a display configured to display a selection made using the manipulation part such that the display indicates whether the upper receiving member is selected or the lower receiving member is selected;

a control part that is electrically connected to the manipulation part and the driving member a door frame disposed below the restraint member: and an avoidance part defined within the door frame, wherein the protruding portion of the restraint member is positioned within the avoidance part when the rotation shaft is rotated to a position in which the protruding portion of the restraint member does not interfere with the upper receiving member, wherein the rotation shaft protrudes outwardly from the back surface of the drawer type door by a predetermined distance, wherein the restraint member is spaced from the back surface of the drawer type door, wherein a bottom part of a front end of the upper receiving member is hooked and restrained between the back surface of the drawer type door and the protruding portion of the restraint member when the rotation shaft is rotated to a position in which the protruding portion of the restraint member restrains the upper receiving member, and wherein the control part is configured to:

receive, from the manipulation part, a selection of the upper receiving member that indicates a desire that the upper receiving member be withdrawn with the drawer type door;

based on the received selection of the upper receiving member:

control the driving member to generate a force that moves the restraint member to a position in which the restraint member restrains the upper receiving member and causes the upper receiving member to be withdrawn with the drawer type door, and control the display to display an indication that the upper receiving member is selected and will be withdrawn with the drawer type door when the drawer type door is withdrawn;

receive, from the manipulation part, a selection of the lower receiving member that indicates a desire that the lower receiving member be withdrawn with the drawer type door without the upper receiving member;

based on the received selection of the lower receiving member:

control the driving member to generate a force that moves the restraint member to a position in which the restraint member does not interfere with the upper receiving member, thereby allowing the drawer type door to be withdrawn without the upper receiving member, and control the display to display an indication that the lower receiving member is selected and will be withdrawn with the drawer type door without the upper receiving member when the drawer type door is withdrawn.

11. The refrigerator according to claim 10, wherein the restraint member has a semicircular shape, and a rotation center of the restraint member is disposed at a central portion of a diameter thereof.

12. The refrigerator according to claim 10, wherein the upper receiving member further comprises a hook groove in which the restraint member is selectively inserted to restrain the restraint member.

13. The refrigerator according to claim 10:

wherein the manipulation part and the display are disposed on a front surface of the drawer type door to enable a user to operate the manipulation part and perceive the display when the drawer type door is oriented in a closed position, and wherein the manipulation part further comprises a lock button that, when pressed, maintains a selection of the upper receiving member or the lower receiving member made using a select button of the manipulation part.

14. The refrigerator according to claim 10, further comprising:

a dispenser disposed on a front surface of the refrigerating compartment door and configured to dispense water; and a door rail assembly that is fixed to the drawer type door and that facilitates sliding of the drawer type door, wherein the manipulation part and the control part are disposed at a position adjacent to the dispenser disposed on the front surface of the refrigerating compartment door, and wherein the control part is electrically connected to the driving member by a wire that is guided through the door rail assembly to the drawer type door.

15. The refrigerator according to claim 1, further comprising:

a manipulation part that enables a user to select the upper receiving member to indicate a desire that the upper receiving member be withdrawn with the drawer type door or to select the lower receiving member to indicate a desire that the lower receiving member be withdrawn with the drawer type door without the upper receiving member; and a display configured to display a selection made using the manipulation part such that the display indicates whether the upper receiving member is selected or the lower receiving member is selected.

* * * * *